US008375665B2

(12) United States Patent
Kaump

(10) Patent No.: US 8,375,665 B2
(45) Date of Patent: Feb. 19, 2013

(54) PARTITION MODULES AND ASSEMBLY SYSTEM THEREOF

(75) Inventor: Donald L. Kaump, Seattle, WA (US)

(73) Assignee: Modular Arts, Inc., Seattle, WA (US)

( * ) Notice: Subject to any disclaimer, the term of this patent is extended or adjusted under 35 U.S.C. 154(b) by 0 days.

(21) Appl. No.: 12/962,510

(22) Filed: Dec. 7, 2010

(65) Prior Publication Data

US 2011/0131915 A1 Jun. 9, 2011

Related U.S. Application Data

(60) Provisional application No. 61/285,139, filed on Dec. 9, 2009.

(51) Int. Cl.
*E04F 13/00* (2006.01)

(52) U.S. Cl. ..... 52/311.1; 52/311.2; 52/311.3; 52/660

(58) Field of Classification Search ..... 52/311.1, 52/3, 311.2, 311.3, 660; 428/156, 172; D25/58, D25/138; D6/332
See application file for complete search history.

(56) References Cited

U.S. PATENT DOCUMENTS

| | | | | | |
|---|---|---|---|---|---|
| 3,229,439 | A * | 1/1966 | Strobel | 52/591.2 |
| 3,617,336 | A * | 11/1971 | Gilard et al. | 428/156 |
| 4,367,615 | A * | 1/1983 | Feldman | 52/591.1 |
| 4,681,481 | A * | 7/1987 | Kapusta | 404/34 |
| 4,698,949 | A * | 10/1987 | Dietrich | 52/415 |
| 5,466,089 | A * | 11/1995 | Jurik | 404/34 |
| 5,813,186 | A * | 9/1998 | Acksel | 52/604 |
| 5,911,660 | A * | 6/1999 | Watson | 52/202 |
| 6,062,772 | A * | 5/2000 | Perkins | 405/284 |
| 6,176,059 | B1 * | 1/2001 | Cantarano et al. | 52/578 |
| 6,253,519 | B1 * | 7/2001 | Daniel | 52/591.1 |
| 6,907,705 | B2 * | 6/2005 | Dean et al. | 52/608 |
| 7,107,731 | B2 * | 9/2006 | Record | 52/309.9 |
| 7,207,146 | B1 * | 4/2007 | Morrell | 52/561 |
| D546,478 | S * | 7/2007 | Adam | D25/113 |
| 7,367,167 | B2 * | 5/2008 | Takayanagi | 52/604 |
| 7,410,328 | B2 * | 8/2008 | Hamel | 405/286 |
| 7,637,688 | B2 * | 12/2009 | Riccobene | 404/41 |
| 7,661,228 | B1 * | 2/2010 | Nolte et al. | 52/79.1 |
| 7,694,485 | B1 * | 4/2010 | Siener | 52/590.2 |
| 8,002,494 | B2 * | 8/2011 | Ciccarello | 404/42 |
| 8,074,419 | B1 * | 12/2011 | Humphress et al. | 52/607 |
| 2002/0078653 | A1 * | 6/2002 | Jean | 52/578 |
| 2010/0101164 | A1 * | 4/2010 | Broden | 52/302.7 |
| 2010/0162642 | A1 * | 7/2010 | Allard et al. | 52/177 |
| 2010/0162648 | A1 * | 7/2010 | Thomassen | 52/311.2 |
| 2010/0242377 | A1 * | 9/2010 | Koteskey | 52/20 |
| 2011/0067333 | A1 * | 3/2011 | Lacas et al. | 52/311.1 |
| 2011/0072753 | A1 * | 3/2011 | MacDonald | 52/562 |
| 2011/0203197 | A1 * | 8/2011 | Najafi et al. | 52/173.1 |
| 2011/0252728 | A1 * | 10/2011 | Scherrer | 52/220.1 |
| 2012/0042599 | A1 * | 2/2012 | Thiagarajan et al. | 52/590.1 |

* cited by examiner

*Primary Examiner* — Brian Glessner
*Assistant Examiner* — Joshua Ihezie
(74) *Attorney, Agent, or Firm* — Seed IP Law Group PLLC

(57) ABSTRACT

A partition module and system of partition modules provides an aesthetically pleasing partition for an interior space of a building. The front and rear exteriors of the module each include three-dimensional surface patterns configured to coextensively align with patterns on adjacent substantially identical modules to form a collective, dual-sided partition having a seamless visual appearance. The partition module may include a recess sized and shaped to receive a beam for supporting the partition structure and a plurality of alignment projections for self-alignment of the partition modules during construction.

20 Claims, 6 Drawing Sheets

PARTITION MODULES AND ASSEMBLY SYSTEM THEREOF

BACKGROUND

1. Technical Field

The present disclosure generally relates to partitions, and more particularly, to partition modules having three-dimensional surface patterns for constructing a collective partition structure, and a system for assembling the same.

2. Description of the Related Art

Partitions for interior spaces in both residential and commercial buildings are well known in the art. For example, in the context of residential buildings well known partitions include partition walls of stud frame and drywall construction. Other known partitions include foldable screen partitions having a number of panels hinged together in an accordion style. In the context of commercial buildings, partition walls are particularly prevalent in office settings to create separate work spaces. For example, upholstered wall panels having interior engineered wood components and polymer trim around a perimeter of the panels are commonly used for work cubicles. These partition structures typically feature flat, opaque surfaces that separate one space from another to create privacy and reduce noise. Construction and assembly of such partitions is generally complicated and laborious.

BRIEF SUMMARY

A partition module for use with at least one adjacent partition module to construct a collective partition structure may be summarized as including a front exterior having at least two distinct three-dimensional front surface regions when viewed in a first direction normal to a central plane of the partition module; a rear exterior having at least two distinct three-dimensional rear surface regions when viewed in a second direction opposite the first direction; and a mating surface perpendicular to the central plane, a first curvilinear portion of a perimeter of the mating surface coincident with at least a portion of a boundary of one of the front surface regions and a second curvilinear portion of the perimeter of the mating surface coincident with at least a portion of a boundary of one of the rear surface regions.

The partition module may further include a second mating surface perpendicular to the central plane and perpendicular to the mating surface, a first curvilinear portion of a perimeter of the second mating surface coincident with at least a portion of the boundary of one of the front surface regions and a second curvilinear portion of the perimeter of the second mating surface coincident with at least a portion of the boundary of one of the rear surface regions. The partition module may further include a plurality of windows extending through the partition module from the front exterior to the rear exterior. Each window may be partially surrounded by at least one intermediate surface aligned normal to the central plane. The front exterior may include a first front surface region distinct from a second front surface region and the first front surface region may be separated from the second front surface region at a boundary therebetween by an intermediate surface aligned normal to the central plane. The rear exterior of the partition module may be substantially a mirror image of the front exterior. The front exterior may be symmetric about a first mid-plane and a second mid-plane, each mid-plane perpendicular to the central plane. The front exterior and rear exterior may lie on a shell of the partition module. The shell may surround an expanded foam interior or a hollow interior.

The partition module may further include a plurality of alignment projections extending from the mating surface, each alignment projection configured to engage a respective alignment recess on a corresponding mating surface of an adjacent partition module. The partition module may further include a recess extending along a length of the partition module, the recess sized and shaped to receive a beam member, such as, a steel stud.

A system for constructing a partition structure may be summarized as including a first partition module including a front exterior having at least two distinct three-dimensional front surface regions when viewed in a first direction normal to a central plane of the partition module, a rear exterior having at least two distinct three-dimensional rear surface regions when viewed in a second direction opposite the first direction, and a mating surface perpendicular to the central plane, a first curvilinear portion of a perimeter of the mating surface coincident with at least a portion of a boundary of one of the front surface regions and a second curvilinear portion of the perimeter of the mating surface coincident with at least a portion of a boundary of one of the rear surface regions; and a second partition module substantially identical to the first partition module, the partition modules configured such that when the first partition module and second partition module are mated, the front exterior and rear exterior of the first partition module continuously align with a corresponding front exterior and a corresponding rear exterior of the second partition module.

DETAILED DESCRIPTION OF THE INVENTION

In the following description, certain specific details are set forth in order to provide a thorough understanding of various embodiments of the invention. However, one skilled in the art will understand that the invention may be practiced without some of these details. In other instances, well-known structures, installation techniques and manufacturing techniques associated with partition wall structures, such as stud frame and drywall partitions, may not be shown or described in detail to avoid unnecessarily obscuring descriptions of the embodiments of the invention.

Figure 1:
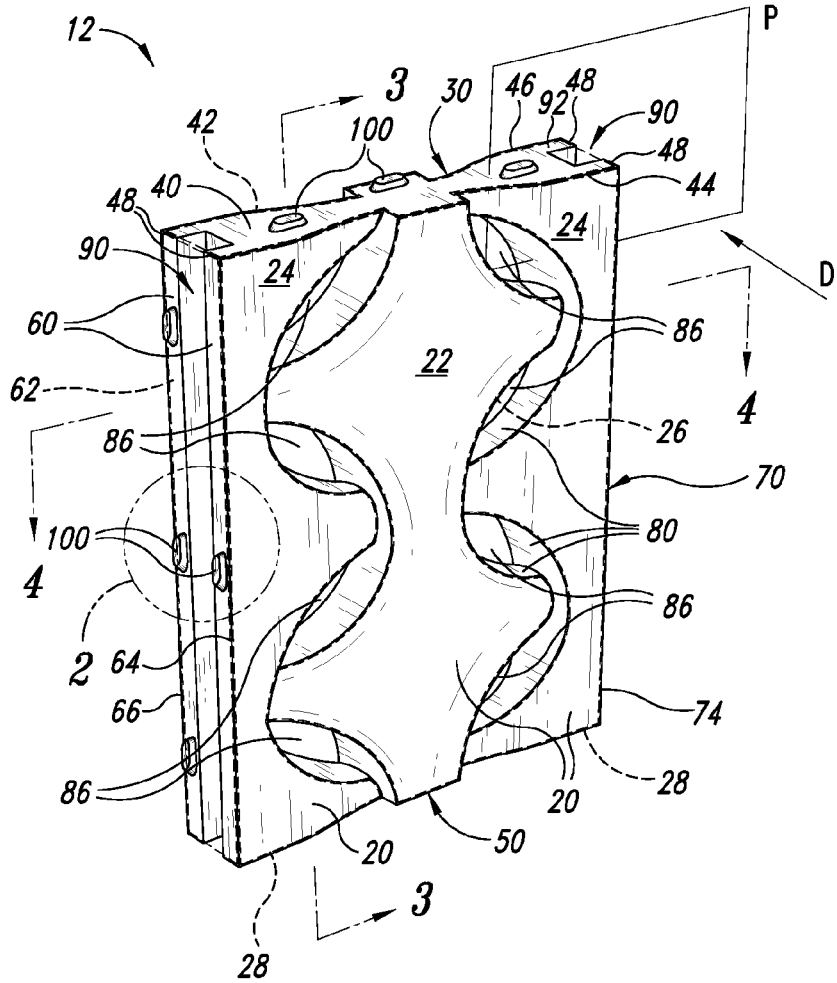
FIG. 1 is a perspective view of a partition module, according to one embodiment.

FIG. 1 illustrates a partition module 12 according to one embodiment. The partition module 12 is generally of a rectangular block configuration with a front exterior 20 and opposing rear exterior 30, each visible to observers from a respective side of the partition module 12. The partition module 12 is configured to be combined with modules 12 of substantially the same configuration in an array to construct a collective partition structure (e.g., a partition wall). The partition module 12 can be predominantly symmetric about a central vertical plane P of the module 12 such that the front exterior 20 and rear exterior 30 are mirror images of each other. In other embodiments, the partition module 12 may be asymmetric about the central vertical plane P such that the front exterior 20 and rear exterior 30 are visually distinct.

The front exterior 20 of the illustrated embodiment includes three distinct three-dimensional surface regions, including a central surface region 22 and two side surface regions 24. Each of the distinct surface regions 22, 24 is bound or bordered by a plurality of edge segments that define a respective perimeter of the surface regions 22, 24. For example, central surface region 22 is bound by a plurality of curvilinear and rectilinear edge segments that collectively define a central surface region perimeter 26 (as illustrated with broken lines). Likewise, side surface regions 24 are each bound by a plurality of curvilinear and rectilinear edge segments that collectively define a respective side surface region perimeter 28 (also illustrated with broken lines). The surface regions 22, 24 of the front exterior 20 bound by respective perimeters 26, 28 are three-dimensional surfaces that interact to create an aesthetically complex and visually intriguing three-dimensional pattern that is particularly well suited for interior design purposes. While contours of each of the central surface region 22 and side surface regions 24 are essentially limitless, the central surface region 22 of the illustrated embodiment depicts a bulging, stacked star configuration and the side surface regions 24 each depict an "E"-shaped configuration that tapers inwardly towards the central surface region 22. Although the front exterior 20 of the illustrated partition module 12 includes three distinct three-dimensional surface regions 22, 24, in some embodiments, the partition module 12 may include fewer distinct three-dimensional surface regions, and in other embodiments, may include four or more distinct three-dimensional surface regions.

Figure 9:
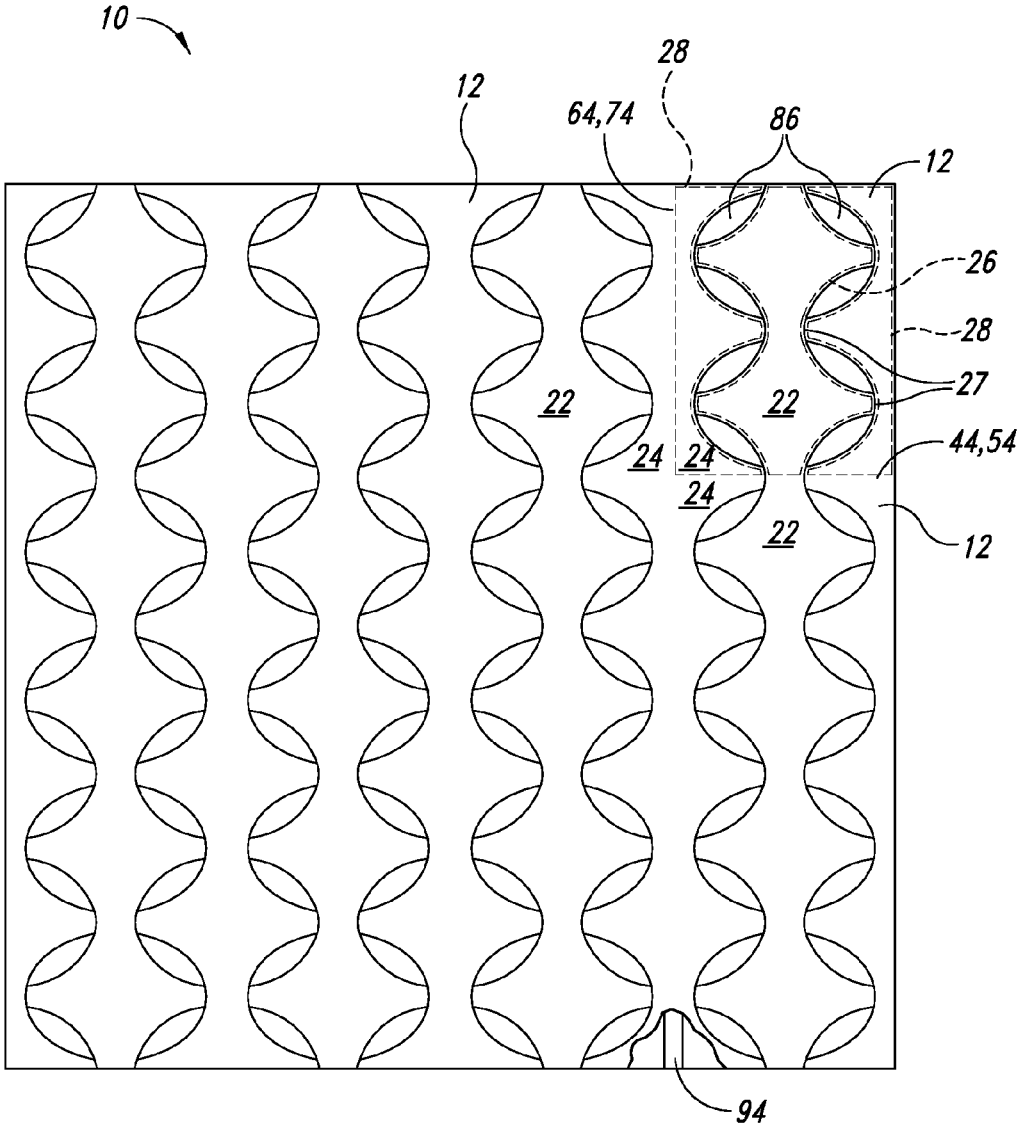
FIG. 9 is a front plan view of a system of partition modules in an assembled state, according to one embodiment.

With continued reference to FIG. 1, when viewing the partition module 12 in a direction D normal to a central vertical plane P of the module 12, the perimeter 26 of the central surface region 22 includes portions that appear coincident or coextensive with portions of the perimeters 28 of the side surface regions 24 (as best shown in FIG. 9). The central surface region 22, however, is separated or offset from the side surface regions 24 at these coinciding boundary locations 27 (FIG. 9) such that the partition module 12 exhibits a stepped increase or decrease in thickness when transitioning between the distinct surface regions 22, 24. Intermediate surfaces 80 aligned normal to the central plane P are shown separating the central surface region 22 from the side surface regions 24. At some coinciding boundary locations the central surface region 22 is offset inwardly from the side surface regions 24, and in other coinciding boundary locations, the central surface region 22 is offset outwardly from the side surface regions 24.

Further, when viewing the partition module 12 in the direction D normal to the central vertical plane P of the module 12, the perimeter 26 of the central surface region 22 includes portions that are separated from portions of the perimeters 28 of the side surface regions 24, such that a plurality of voids or windows 86 extending through the module 12 are defined therebetween. The illustrated embodiment includes eight ovoid shaped windows 86 interspersed throughout the partition module 12; however, the number and shape of the windows 86 may vary in other embodiments. Partition modules 12 having windows 86 are particularly well suited for constructing partition walls that effectively separate one space from another while simultaneously allowing light and partial visibility therebetween. In some embodiments, the modules 12 may not include windows 86 and instead may be substantially opaque or include translucent regions. In some embodiments, windows 86 may be surrounded or defined in part by intermediate surfaces 80 aligned normal to the central plane P (as shown in FIG. 1) or may be surrounded or defined by surfaces that converge or diverge from one side of the module 12 to the other. In some embodiments, windows 86 may include glass inserts to effectively seal space on one side of the module 12 from the other.

As discussed above, the partition module 12 illustrated in FIG. 1 is predominately symmetric about a central vertical plane P of the module 12 such that the front exterior 20 and rear exterior 30 are mirror images of each other, and in other embodiments, the partition module 12 may be asymmetric such that the front exterior 20 and rear exterior 30 are visually distinct. In either case, the rear exterior 30 likewise includes at least two distinct three-dimensional surface regions that interact to create an aesthetically complex and visually intriguing configuration.

The partition module 12 of FIG. 1 further includes an upper mating surface 40, a lower mating surface 50 and side mating surfaces 60, 70 for aligning with corresponding mating surfaces of adjacent partition modules 12. Each of the mating surfaces 40, 50, 60, 70 are shown perpendicular to the central plane P with the upper and lower mating surfaces 40, 50 extending horizontally and the side mating surfaces 60, 70 extending vertically.

The upper mating surface 40 is bound or externally bordered by a perimeter 42 (illustrated in broken lines) formed of a plurality of curvilinear and rectilinear line segments wherein one or more of the line segments coincide with a front upper edge 44, a rear upper edge 46 and side upper edges 48 (which are shown interrupted by recesses 90) of the partition module 12. As shown in FIG. 1, a rectilinear portion of the front upper edge 44 is coincident with a corresponding portion of the perimeter 26 of the central surface region 22 of the front exterior 20 and curvilinear portions of the front upper edge 44 are coincident with respective portions of the perimeters 28 of the side surface regions 24 of the front exterior 20. Likewise, a rectilinear portion of the rear upper edge 46 is coincident with a portion of the perimeter of a central surface region (not visible) of the rear exterior 30 and curvilinear portions of the rear upper edge 46 are coincident with respective portions of the perimeters of side surface regions (not visible) of the rear exterior 30. Although not visible in FIG. 1, it will be appreciated by those of skill in the art that lower mating surface 50 is of a similar or same configuration as upper mating surface 40. Accordingly, the upper and lower mating surfaces 40, 50 each include perimeters having rectilinear and/or curvilinear edge segments wherein at least portions of the rectilinear and/or curvilinear edge segments respectively trace or map to boundaries of the distinct three-dimensional surface regions located on both sides of the partition module 12. In this manner, the partition module 12 is particularly well adapted to create visually stunning dual-sided structures of varying complexity. In some embodiments, the lower mating surface 50 is of substantially the same form as the upper mating surface 40 including a perimeter that is a mirror image of the perimeter 42 of the upper mating surface taken about a horizontal mid-plane (not shown) extending perpendicular to the central plane P. In other embodiments, a perimeter of the lower mating surface 50 may be asymmetric with respect to the upper mating surface 40 about the horizontal mid-plane.

The side mating surfaces 60, 70 are similarly bound or externally bordered by a respective perimeter 62 formed of line segments wherein one or more of the line segments coincide with a front side edge 64, 74, a rear side edge 66 and side upper edges 48 (which are shown interrupted by recesses 90) of the partition module 12. The illustrated embodiment of FIG. 1 includes a pair of substantially coplanar side mating surfaces on a first side of the module 12 which are collectively referred to herein as the first side mating surface 60. The perimeter 62 of the first side mating surface 60 includes a substantially rectilinear front side edge 64 and a substantially rectilinear rear side edge 66 that are coincident with a corresponding portion of the perimeter 28 of a side surface region 24 of the front exterior 20 and a corresponding portion of a perimeter of a side surface region (not visible) of the rear exterior 30. Accordingly, this embodiment is particularly well suited for constructing partition structures having substantially flat vertical seams, which reduces the skill necessary to fill and conceal the seams. In other embodiments, the perimeter 62 of the first side mating surface 60 may include curvilinear front and rear side edges 64, 66, such as, for example, the embodiment illustrated in FIG. 7, or composite edges comprising both curvilinear and rectilinear portions.

Another pair of substantially coplanar side mating surfaces are located on the opposite side of the module 12 and are referred to herein as the second side mating surface 70. The second side mating surface 70 is of substantially the same form as the first side mating surface 60 including a perimeter that is a mirror image of the perimeter 62 of the first side mating surface 60 taken about a vertical mid-plane (not shown) extending perpendicular to the central plane P. In other embodiments, the perimeter of the second side mating surface 70 may be asymmetric with respect to the first side mating surface 60 about the vertical mid-plane.

The partition module 12 of FIG. 1 further includes a channel or elongated recess 90 on each side of the partition module 12. The recess 90 extends a full height of the partition module 12 and is sized and shaped to receive at least a portion of a beam member (e.g., steel stud) to support and/or stabilize the module 12 when erecting or constructing a partition structure 10 comprising an array of such modules 12. More particularly, the elongated recess 90 on each side of the module 12 interoperates or cooperates with a corresponding elongated recess 90 on adjacent modules 12 to form an elongated cavity sized and shaped to receive various beam members. Consequently, the partition module 12 includes a plurality of fingers or flanges 92 that project from the sides of the module 12 to surround, enclose and conceal the beam member within the completed partition structure 10. According to some embodiments, the recesses 90 are located on a partition module 12 having a width sized to receive studs 94 that are spaced at regular intervals common in wall construction, such as, for example, studs 94 spaced at 16 inches or 24 inches on center. Although the illustrated recesses 90 are depicted as rectangular cavities, it is appreciated that the recesses 90 may vary to receive beam members of various sizes and shapes, such as, for example, cylindrical beams of varying diameters or i-beams of varying cross-sections. In some embodiments, the partition modules 12 are self-supporting and may not include recesses to receive such beam members.

Figure 2:
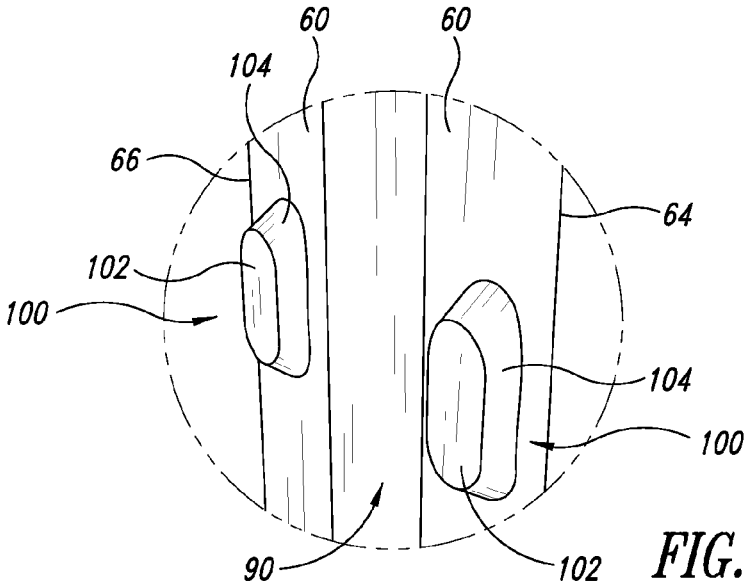
FIG. 2 is a partial detail view of the partition module of FIG. 1.

The partition module 12 of FIG. 1 further includes a plurality of projections 100 extending outwardly from mating surfaces 40, 60 of the partition module 12. The projections 100 are configured to interoperate with corresponding recesses (not shown) located on opposing mating surfaces of adjacent modules 12 to facilitate alignment of the modules 12 during construction of a partition structure 10 such that the three-dimensional patterns on the front exterior 20 and rear exterior 30 visually flow from one module 12 to the next. Further details of the alignment projections 100 of the illustrated embodiment may be seen more clearly in the partial detail view of FIG. 2. As illustrated in FIG. 2, each projection 100 may include a substantially flat oval shaped engagement surface 102 offset from the partition module 12 and may include side-walls 104 that slope outwardly from the engagement surface 102 towards the partition module 12. In some applications it may be preferable that the alignment projections 100 and corresponding recesses are sized to leave a small gap or space between adjacent modules 12 of a constructed partition structure 10. Thus, in some embodiments, a height of at least one of the projections is greater than the depth of a corresponding recess to create a small standoff and hence gap between adjacent modules 12. This gives the partition structure 10 some play to relieve stress due to thermal expansion or contraction or to account for settling of the structure or the base to which it may be attached.

Figure 3:
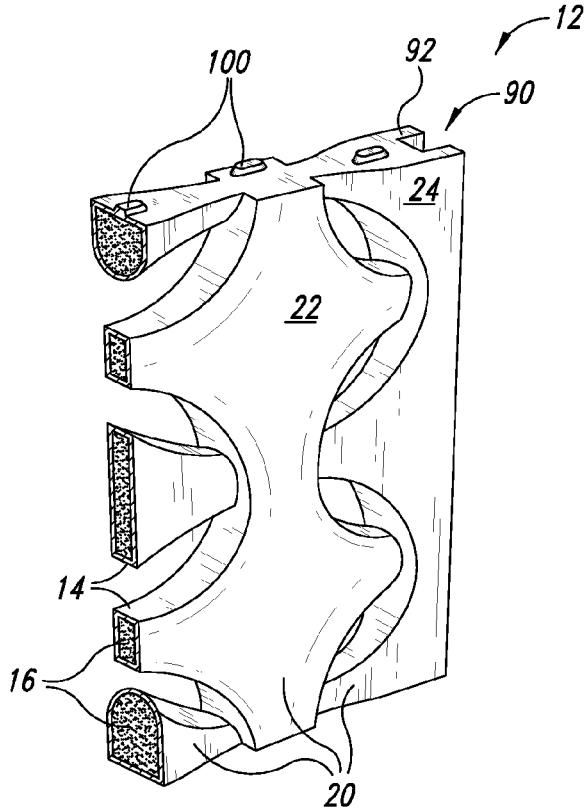
FIG. 3 is a cross-sectional perspective view of the partition module of FIG. 1 taken along line 3-3, according to an embodiment having a core interior.
Figure 4:
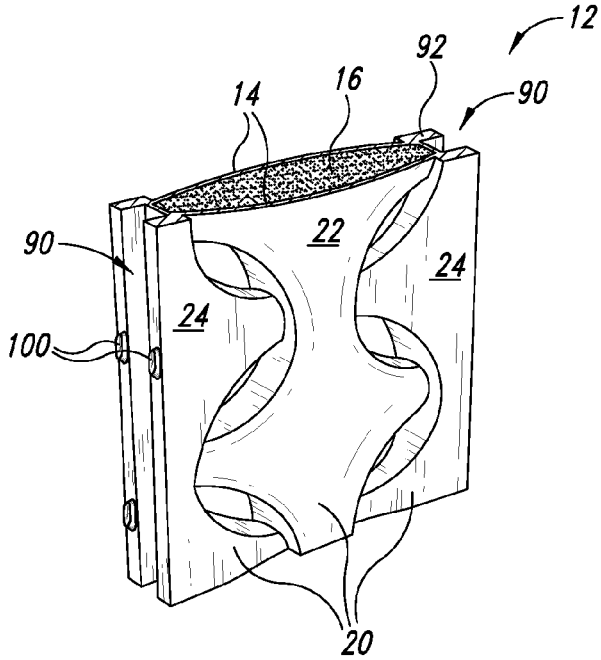
FIG. 4 is a cross-sectional perspective view of the partition module of FIG. 1 taken along line 4-4, according to an embodiment having a core interior.
Figure 5:
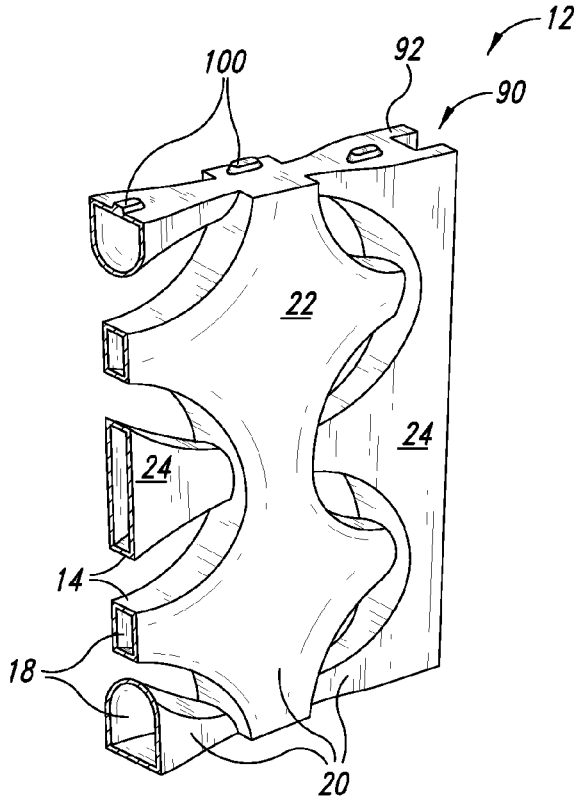
FIG. 5 is a cross-sectional perspective view of the partition module of FIG. 1 taken along line 3-3, according to an embodiment having a hollow interior.
Figure 6:
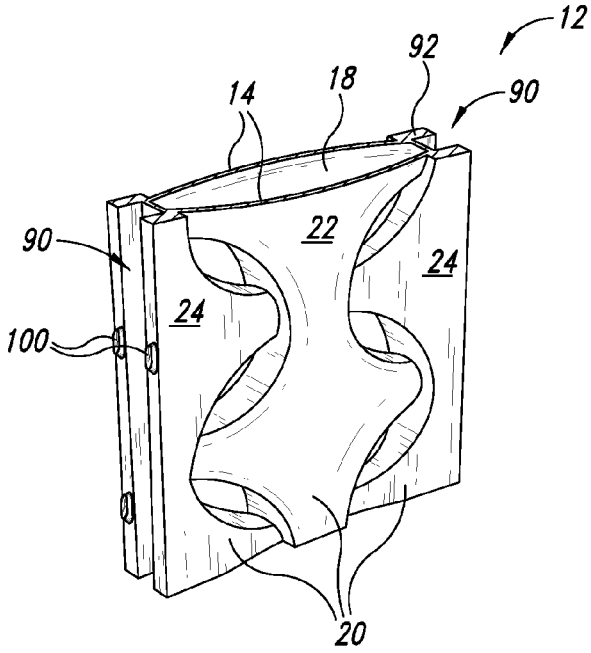
FIG. 6 is a cross-sectional perspective view of the partition module of FIG. 1 taken along line 4-4, according to an embodiment having a hollow interior.

FIGS. 3 through 6 illustrate a partition module 12 having an external shell structure 14. As illustrated in FIGS. 3 and 4, the shell structure 14 may enclose an interior portion 16 comprising a material different than a material of the shell structure 14. For example, the external shell 14 may comprise a gypsum-based composite reinforced with glass fibers and the interior 16 may comprise a foam material, the density of the shell structure 14 being significantly greater than the density of the foam interior. In other embodiments, the shell structure 14 may surround a hollow cavity 18, as illustrated in FIGS. 5 and 6. In still other embodiments, the partition module 12 may be fabricated as a unitary body of material, such as, for example, a solid partition module 12 of a gypsum-based material.

The partition modules 12 may be formed via various known manufacturing methods, such as, for example, various machining, casting or molding processes. In one embodiment, the partition module 12 is fabricated using a centrifugal casting or rotocasting method to produce a structural shell 14, which may be filled or unfilled, for example, as described above.

Figure 7:
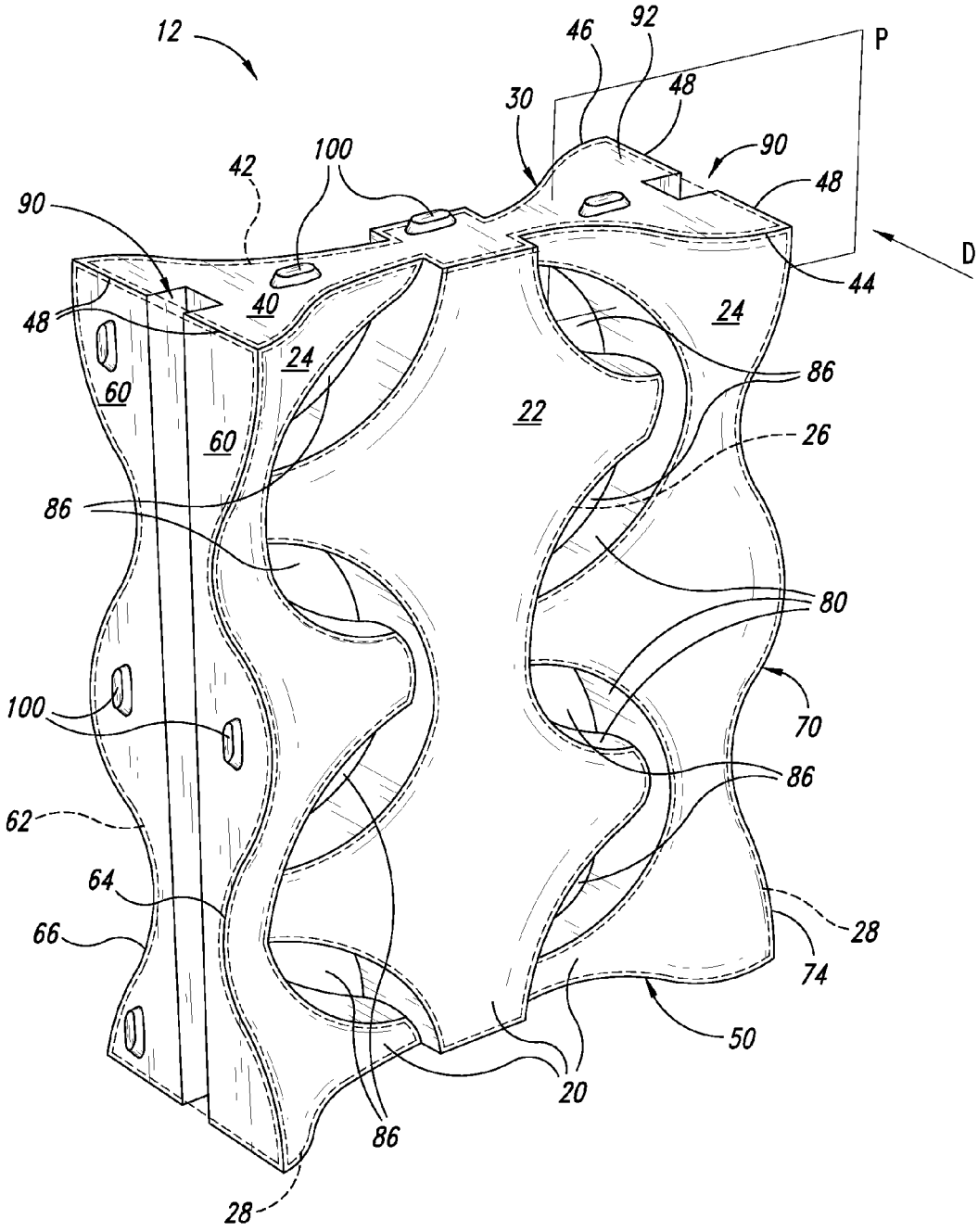
FIG. 7 is a perspective view of a partition module, according to one embodiment.

FIG. 7 illustrates another embodiment of a partition module 12. This module 12 illustrates a variation in which the side mating surfaces 60, 70 of the module 12 each include front side edges 64, 74 and rear side edges 66 that comprise a single curvilinear edge. This partition module 12 may be used to construct a partition structure 10 that has a particularly rolling visual effect. Other embodiments may include side mating surfaces 60, 70 that have composite front side edges and rear side edges comprising curvilinear and rectilinear edge portions.

Figure 8:
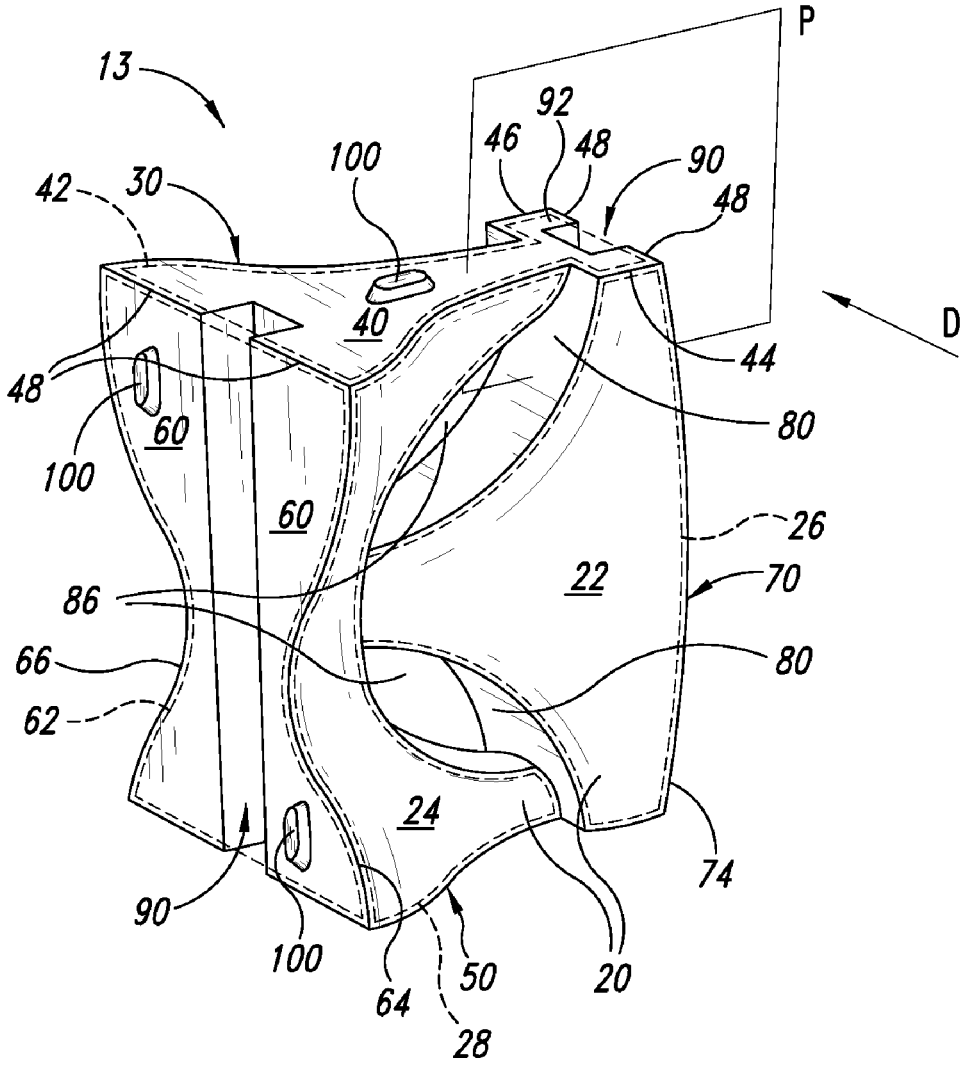
FIG. 8 is a perspective view of a partition sub-module, according to one embodiment.

FIG. 8 illustrates yet another embodiment, in which a sub-module 13 comprises essentially a quarter-section of the partition module 12 shown in FIG. 7. As illustrated, opposing side mating surfaces of this embodiment are asymmetric. Consequently, in order to construct a collective partition structure 10 having a comprehensive three-dimensional pattern that flows continuously across the partition structure 10, several correspondingly shaped sub-modules 13 of differing configurations are required.

FIG. 9 illustrates a system for constructing a partition structure 10 (e.g., a partition wall) comprising a plurality of partition modules 12. The partition modules 12 are substantially identical and positioned in an array to create the collective partition structure 10. For example, as illustrated in FIG. 9, an array of twelve modules 12 may be aligned in three stacked rows of four modules. Once assembled, the modules 12 interoperate or cooperate with each other to form a comprehensive three-dimensional pattern that flows continuously across the partition structure 10 in all directions. The illustrated three-dimensional pattern is one of numerous three-dimensional patterns that may be formed.

The modules 12 are self-aligning during assembly as a result of the engagement of alignment projections 100 on each of the modules 12 with corresponding recesses on adjacent modules 12. As discussed above, the engagement of the alignment projections 100 and corresponding recesses assures that the overall partition structure 10 will have a continual, flowing visual appearance when the structure is completed. Further, the alignment projections 100 of terminal modules of an erected partition structure 10 may be removed during construction, for example, by grinding the projections 100, to create a partition structure 10 having substantially flat terminal ends. In this manner, the partition structure 10 can interface with or abut, for example, a transverse wall or other structure. In addition, the projections 100 may be ground as needed to adjust for slight manufacturing deviations and assist in aligning partition modules 12 during construction.

The system may further include a number of beam members, such as, for example, steel studs 94. These beam members may be inserted through elongated recesses 90 in the partition structure 10 after the module array is completed or may be installed in a step-wise fashion after each column of modules 12 is erected. The beams may be secured to a base structure or overhead structure, such as a floor or ceiling, to secure and support the partition structure 10 in a rigid, upright fashion. The modules 12 may also be secured to the beam member by various attachment means, such as, for example, screws, bolts or other fasteners. In this manner, in addition to structural support, the beam members aid in preventing any shifting or settling of the modules 12 with respect to each other.

In some embodiments, the system for constructing a partition structure 10 may further comprise a bonding agent applied between adjacent partition modules 12. The bonding agent can be a polyurethane glue or a construction mastic such as LIQUID NAILS®. In some embodiments, the system may further comprise a filler material applied in the seams between adjacent partition modules 12 that may be subsequently sanded. A preferred filler comprises a vinyl or acrylic additive, is softer than the structural skin, and can be easily sanded. Fillers such as DAP® Vinyl Spackling or DAP® FAST 'N FINAL®Lightweight Spackling, both commonly available, work well for filling the seams between adjacent partition modules 12. Once sanded, the individual partition modules 12 become undistinguishable from adjacent modules 12 and hence create a collective partition structure 10 having a comprehensive three-dimensional pattern that flows continuously across the partition structure 10 in all directions. A sealant and/or paint layer may also be provided to enhance and/or preserve the exterior appearance of the completed structure 10.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A partition module for use with at least one adjacent partition module to construct a collective partition structure that is perforated to enable viewing between spaces on opposing sides of the collective partition structure, the partition module comprising:

a front exterior having at least two distinct three-dimensional front surface regions when viewed in a first direction normal to a central plane of the partition module, the at least two distinct three-dimensional front surface regions extending to an outer perimeter of the front exterior;

a rear exterior having at least two distinct three-dimensional rear surface regions when viewed in a second direction opposite the first direction, the at least two distinct three-dimensional rear surface regions extending to an outer perimeter of the rear exterior; and a mating surface perpendicular to the central plane, a first curvilinear portion of a perimeter of the mating surface coincident with at least a portion of a boundary of one of the front surface regions at the outer perimeter of the front exterior and a second curvilinear portion of the perimeter of the mating surface coincident with at least a portion of a boundary of one of the rear surface regions at the outer perimeter of the rear exterior; and at least one window extending entirely through the partition module which at least partially separates the at least two distinct three-dimensional front surface regions and which at least partially separates the at least two distinct three-dimensional rear surface regions.

2. The partition module of claim 1, further comprising:

a second mating surface perpendicular to the central plane and perpendicular to the mating surface, a first curvilinear portion of a perimeter of the second mating surface coincident with at least a portion of the boundary of one of the front surface regions at the outer perimeter of the front exterior and a second curvilinear portion of the perimeter of the second mating surface coincident with at least a portion of the boundary of one of the rear surface regions at the outer perimeter of the rear exterior.

3. The partition module of claim 1, wherein the partition module includes a plurality of windows extending entirely through the partition module from the front exterior to the rear exterior.

4. The partition module of claim 3 wherein each window is partially surrounded by at least one intermediate surface aligned normal to the central plane.

5. The partition module of claim 1 wherein the front exterior includes a first front surface region distinct from a second front surface region and the first front surface region is separated from the second front surface region at a boundary therebetween by an intermediate surface angled with respect to the central plane.

6. The partition module of claim 1 wherein the rear exterior of the partition module is substantially a mirror image of the front exterior.

7. The partition module of claim 1 wherein the front exterior is symmetric about a first mid-plane and a second mid-plane, each mid-plane perpendicular to the central plane.

8. The partition module of claim 1 wherein the front exterior and rear exterior lie on a shell of the partition module.

9. The partition module of claim 8 wherein the shell surrounds an expanded foam interior.

10. The partition module of claim 8 wherein the shell surrounds a hollow interior.

11. The partition module of claim 1, further comprising:

a plurality of alignment projections extending from the mating surface, each alignment projection configured to engage a respective alignment recess on a corresponding mating surface of an adjacent partition module.

12. The partition module of claim 1, further comprising:

a recess extending along a length of the partition module, the recess sized and shaped to receive a beam member, the recess formed in the partition module to align with corresponding recesses of adjacent, vertically aligned partition modules to enable the beam member to extend an overall height of the collective partition structure.

13. The partition module of claim 12 wherein the recess is size and shaped to receive a beam member in the form of a structural steel stud.

14. A partition module for use with at least one adjacent partition module to construct a collective partition structure, the partition module comprising:

a front exterior having at least two distinct three-dimensional front surface regions when viewed in a first direction normal to a central plane of the partition module, the at least two distinct three-dimensional front surface regions extending to an outer perimeter of the front exterior;

a rear exterior having at least two distinct three-dimensional rear surface regions when viewed in a second direction opposite the first direction, the at least two distinct three-dimensional rear surface regions extending to an outer perimeter of the rear exterior;

at least one window extending entirely through the partition module which at least partially separates the at least two distinct three-dimensional front surface regions and which at least partially separates the at least two distinct three-dimensional rear surface regions; and a pair of stud recesses, each stud recess extending along a length of a respective side of the partition module, the pair of stud recesses formed in the partition module to align with corresponding recesses of adjacent, vertically aligned partition modules to enable a stud to extend an overall height of the collective partition structure.

15. The partition module of claim 14, further comprising:

a mating surface perpendicular to the central plane, a first curvilinear portion of a perimeter of the mating surface coincident with at least a portion of a boundary of one of the front surface regions and a second portion of the perimeter of the mating surface coincident with at least a portion of a boundary of one of the rear surface regions.

16. The partition module of claim 15, further comprising:

a second mating surface perpendicular to the central plane and perpendicular to the mating surface, a first curvilinear portion of a perimeter of the second mating surface coincident with at least a portion of the boundary of one of the front surface regions and a second curvilinear portion of the perimeter of the second mating surface coincident with at least a portion of the boundary of one of the rear surface regions.

17. The partition module of claim 14 wherein the rear exterior of the partition module is substantially a mirror image of the front exterior.

18. The partition module of claim 14 wherein the front exterior is symmetric about a first mid-plane and a second mid-plane, each mid-plane perpendicular to the central plane.

19. A partition structure that is perforated to enable viewing between spaces on opposing sides thereof, the partition structure comprising:

a plurality of partition modules stacked side-by-side and end-to-end to form a perforated wall with stud cavities extending an entire height thereof, each partition module including:

a front exterior having at least two distinct three-dimensional front surface regions when viewed in a first direction normal to a central plane of the partition module, the at least two distinct three-dimensional front surface regions extending to an outer perimeter of the front exterior;

a rear exterior having at least two distinct three-dimensional rear surface regions when viewed in a second direction opposite the first direction, the at least two distinct three-dimensional rear surface regions extending to an outer perimeter of the rear exterior;

a mating surface perpendicular to the central plane, a first curvilinear portion of a perimeter of the mating surface coincident with at least a portion of a boundary of one of the front surface regions and a second curvilinear portion of the perimeter of the mating surface coincident with at least a portion of a boundary of one of the rear surface regions; and at least one window extending entirely through the partition module which at least partially separates the at least two distinct three-dimensional front surface regions and which at least partially separates the at least two distinct three-dimensional rear surface regions; and a plurality of studs received in the stud cavities to support the plurality of partition modules in an erected configuration with the front exterior and the rear exterior of each partition module continuously aligned with a corresponding front exterior and a corresponding rear exterior of each adjacent partition module thereto.

20. The partition structure of claim 19 wherein each partition module includes a second mating surface perpendicular to the central plane and perpendicular to the mating surface, a first curvilinear portion of a perimeter of the second mating surface being coincident with at least a portion of the boundary of one of the front surface regions and a second curvilinear portion of the perimeter of the second mating surface being coincident with at least a portion of the boundary of one of the rear surface regions.

* * * * *